US011808231B2

(12) United States Patent
Solla

(10) Patent No.: US 11,808,231 B2
(45) Date of Patent: Nov. 7, 2023

(54) NEGATIVE PRESSURE OPERATING METHOD

(71) Applicant: Felix Solla, Bayamón, PR (US)

(72) Inventor: Felix Solla, Bayamón, PR (US)

(73) Assignees: Carmen Rodríguez Báez, Bayamón, PR (US); Raisa Solla Rodríguez, Bayamón, PR (US)

( * ) Notice: Subject to any disclaimer, the term of this patent is extended or adjusted under 35 U.S.C. 154(b) by 0 days.

(21) Appl. No.: 18/071,982

(22) Filed: Nov. 30, 2022

(65) Prior Publication Data

US 2023/0175451 A1 Jun. 8, 2023

Related U.S. Application Data

(60) Provisional application No. 63/287,385, filed on Dec. 8, 2021.

(51) Int. Cl.
*F02D 41/36* (2006.01)
*F02D 41/30* (2006.01)
*F02D 41/00* (2006.01)

(52) U.S. Cl.
CPC ..... *F02D 41/36* (2013.01); *F02D 41/3017* (2013.01); *F02D 2041/001* (2013.01)

(58) Field of Classification Search
CPC ..... F02D 41/36; F02D 41/32; F02D 41/3017; F02D 2041/001; F02B 29/08; F02B 29/083; F02B 41/02; F02B 2075/023; F02B 2075/025; F02B 2720/23; F02B 2720/238
USPC ..... 123/572
See application file for complete search history.

(56) References Cited

U.S. PATENT DOCUMENTS

2006/0201152 A1* 9/2006 Irisawa ..... F02D 41/3029 60/605.1
2009/0133391 A1* 5/2009 Porten ..... F01N 3/0842 60/303
2011/0220058 A1* 9/2011 Cleeves ..... F02D 41/3011 123/295
2015/0068493 A1* 3/2015 Gaenzle ..... F02D 35/028 123/339.11

* cited by examiner

*Primary Examiner* — Lindsay M Low
*Assistant Examiner* — Omar Morales
(74) *Attorney, Agent, or Firm* — Aldarondo IP LLC; Carlos A. Aldarondo-López

(57) ABSTRACT

Method of operating an internal combustion engine that applies to both types of ignition types; Spark Ignition (SI) and Compression Ignition (CI). The method comprises opening the intake valve, allowing the fuel and air mixture to flow through the intake valve and into the chamber during at least during a portion of the intake stroke; closing the intake port during a portion of the intake stroke; applying a negative pressure during a portion of the intake stroke; directly or indirectly igniting the fuel and air mixture during a portion of the intake stroke; opening the exhaust valve during the exhaust stroke.
The operation of intake valve, the exhaust valve, and the application of the ignition source is performed at any time during the intake and/or exhaust stroke or cycle.

6 Claims, 10 Drawing Sheets

NEGATIVE PRESSURE OPERATING METHOD

CROSS-REFERENCE TO RELATED APPLICATIONS

This application claims the benefit of U.S. Provisional Patent Application No. 63/287,385 filed on Dec. 8, 2021, which is incorporated by reference herein in its entirety.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

Trademarks may be used in the disclosure of the invention and the applicant makes no claim to any such referenced trademarks.

BACKGROUND OF THE INVENTION

1) Field of the Invention

The invention relates to the field of Internal combustion engines. An internal combustion engine (ICE or IC engine) is a heat engine in which the combustion of a fuel occurs with an oxidizer (usually air) in a combustion chamber that is an integral part of the working fluid flow circuit. In an internal combustion engine, the expansion of the high-temperature and high-pressure gases produced by combustion applies direct force to some component of the engine. The force is typically applied to pistons (piston engine), turbine blades (gas turbine), a rotor (Wankel engine), or a nozzle (jet engine). This force moves the component over a distance, transforming chemical energy into kinetic energy which is used to propel, move or power whatever the engine is attached to. This replaced the external combustion engine for applications where the weight or size of an engine was more important.

However, most internal combustion engines have an efficiency of approximately 30%. This lack of efficiency is due in part to the energy that is required to compress the mixture of air and fuel. The initial mixture is compressed to 12 times original volume (12:1). Internal combustion engines in general complete one cycle with two revolutions of the crankshaft.

2) Description of Related Art

Currently the state of the art includes the basic reciprocating engine design which has one or more cylinders in which pistons reciprocate back and forth. The combustion chamber is located in the closed end of each cylinder. Power is delivered to a rotating output crankshaft by mechanical linkage with the pistons. The rotary engine is made of a block (stator) built around a large non-concentric rotor and crankshaft. The combustion chambers are built into the non-rotating block.

The basic reciprocating engine has both a four stroke and two stroke design.

The four stroke-cycles refers to its use in gasoline engines, gas engines, light, oil engine and heavy oil engines in which the mixture of air fuel are drawn in the engine cylinder. The ignition in these engines is due to a spark, therefore they are also called spark ignition engines.

In two stroke cycle engines, the whole sequence of events i.e., suction, compression, power and exhaust are completed in two strokes of the piston i.e. one revolution of the crankshaft. There is no valve in this type of engine. Gas movement takes place through holes called ports in the cylinder. The crankcase of the engine is airtight in which the crankshaft rotates.

In particular, there is a need for an easy to fabricate and fuel-efficient design for a combustion-based engine.

BRIEF SUMMARY OF THE INVENTION

The instant invention in one form is directed to an internal combustion engine that uses a vacuum instead of a compressive force to produce the output. The design of the engine is such that it uses less fuel and will produce more power output than current comparable internal combustion engines. 1 cycle is completed with 1 crankshaft revolution. Whereas a comparable internal combustion engine completes 1 cycle with 2 crankshaft revolutions.

Less energy is required to apply the vacuum or negative force to the fuel and air mixture than the energy required to compress the fuel and air mixture. The engine valves may be operated by a cam or electromechanical valve actuators.

The instant invention method of operation works similar to a conventional internal combustion engine except that instead of applying a compressive force to the fuel mixture, it applies a negative compressive or vacuum force to the fuel mixture.

An advantage of the present invention is that it allows internal combustion engine manufacturers to produce small form factor machines or tools, for example road vehicles, lawn cutters, chainsaws, etc., with higher fuel efficiency than engines currently used and with reduced emissions.

Another advantage of the present invention is that the amount of mechanical components of the engine are reduced.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION

Figure 1:
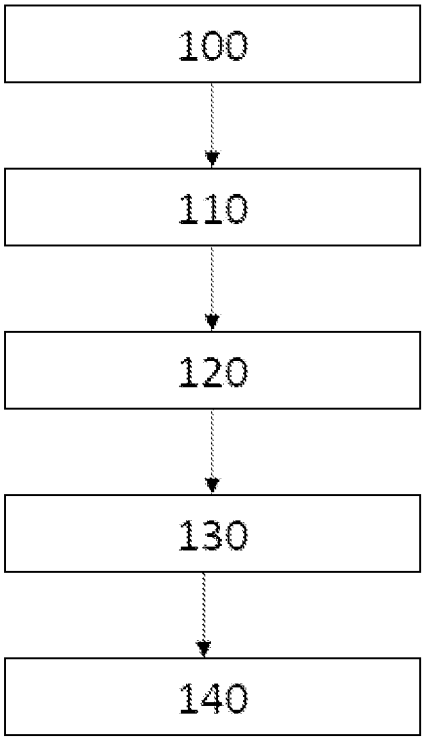
FIG. 1 is a flow chart of the Negative Pressure Operating Method using a Spark Ignition Powered Internal Combustion Engine process.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for purposes of explanation, numerous specific details are set forth to provide a thorough understanding of the described embodiments. It will be apparent to one skilled in the art however that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise and use of the terms "and" and "or" is equivalent to "and/or", also referred to as "non-exclusive or" unless otherwise indicated. Moreover, the use of the term "including", as well as other forms, such as "includes" and "included", should be considered non-exclusive. Also, terms such as "element" or "component" encompass both elements and components including one unit and elements and components that include more than one unit, unless specifically stated otherwise.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C". An exception to this definition will occur only when a combination of elements, functions, steps or acts are in some way inherently mutually exclusive.

As this invention is susceptible to embodiments of many different forms, it is intended that the present disclosure be considered as an example of the principles of the invention and not intended to limit the invention to the specific embodiments shown and described.

The terms fuel supply as used within the specification is intended to mean gasoline, petrol, diesel, natural gas fuel or any solid, liquid or gas substance that can be used to drive the instant invention.

Prior to a discussion of the preferred embodiment of the invention, it should be understood that while the features and advantages of the invention are illustrated in terms of a reciprocating engine with Negative Pressure Operating Method the technology can also be adapted for use with a Positive Pressure Operating Method.

Automotive vehicle and engine manufacturers and various technical societies such as the SAE International share in the desire for efficient, effective transportation. The balance between combustion processes to produce power, and those processes which create pollution, is best addressed by enhancing the fundamental efficiency of the internal combustion engine processes.

The Otto cycle is the ideal cycle for spark-ignition engines. It consists of four internal reversible processes: 1-2 Isentropic compression. 2-3 Constant volume heat addition. An engine based on the Otto cycle consists of a compression process of a fuel-air mixture followed by unregulated combustion. It is well known that for a given compression ratio the ideal Otto cycle is the most efficient expanding chamber piston engine since the Otto cycle combines high peak temperature with a practical average temperature of heat input. However, the high peak combustion temperature of an Otto engine can cause auto-ignition of a portion of the fuel-air mixture, resulting in engine noise and damage to the engine, as well as the creation of excess amounts of undesired nitrogen oxides. Nitrogen oxides are most relevant for air pollution and include nitric oxide (NO) and nitrogen dioxide (NO) and are commonly referred to as NOx.

Current internal combustion engines convert only about 12%-30% of the energy from the fuel into usable motion, depending on the drive cycle. The rest of the energy is lost to heat, engine and driveline inefficiencies or used to power accessories. Because these engines have such a low efficiency there is a huge potential to improve fuel efficiency with advanced technology. Just increasing fuel efficiency could help reduce the global CO2 emissions from transportation and power generation related processes.

The internal combustion engine market is expected to grow from US $55,176.7 million in 2020 to US$73,842.5 million by 2028. This translates to a CAGR of 3.71% during 2020-2028 period. This provides tremendous opportunity for a technology that can improve efficiency.

Technological advancements are resulting in the evolution of internal combustion engines, allowing them to offer high power outputs with improved fuel efficiency. Meanwhile, the engines continue to be vital in the development of the automotive industry. Further, they have a potential for improvement in various areas such as thermal efficiency, emissions, and electrification. The internal combustion engine allows manufacturers to produce small form factor machine or tools, for example road vehicles, lawn mowers, chainsaws, etc. which have enormous industrial application. Internal combustion engines are also critical to motorboats and ships which propel the marine applications and there is a critical need for heavy power output engines that are used in power generation.

For general purpose road use, the engines of emission-constrained passenger cars are presently limited to useful compression of about 10:1. Above that limit the increased cost of the fuel control system and the additional cost of more platinum or rhodium for exhaust catalytic converters generally outweighs the benefit of higher compression ratios. A technology which would allow a practical Otto compression process to operate more efficiently in terms of fuel economy and at lower operating temperatures, would be a significant advancement in the art.

Comparing the instant invention to the Scuderi split cycle internal combustion engine. This invention differs from the Scuderi split cycle internal combustion engine in that the four strokes are completed in one cycle of each cylinder individually, thus completing one cycle in one revolution of the crankcase. The four strokes of this method of operating an internal combustion engine consist of the fuel/air intake stroke, the compressive or negative pressure stroke, ignition stroke, and the exhaust stroke.

The Negative Pressure Operating Method differs from the Scuderi split cycle internal combustion engine, in that the engine is operated as a One-Stroke One-Cycle engine. This one-stroke one-cycle operating method has one piston movement over one revolution for each cycle.

Scuderi Split-cycle engines divides the four strokes of intake, compression, power, and exhaust into two separate but paired cylinders.

The Negative Pressure Operating Method completes the four strokes of intake, compression, power, and exhaust into a single cylinder.

The Scuderi Split-cycle internal engine uses engines comprised of two cylinders and they have a 4 stoke cycle.

The Negative Pressure Operating Method can be used in engines with any number of cylinders.

Ignition types—there are two types of ignition methods currently employed in internal combustion engines.

a) Spark Ignition (SI). A SI engine starts the combustion process in each cycle by use of a spark plug. The spark plug gives a high-voltage electrical discharge between two electrodes which ignites the air-fuel mixture in the combustion chamber surrounding the plug.

b) Compression Ignition (CI). The combustion process in a CI engine starts when the air-fuel mixture self-ignites due to high temperature in the combustion chamber caused by high compression.

The Negative Pressure Operating Method has features of both the spark ignited and compression ignited engines.

Number of strokes per cycle—there are two types of engine cycles systems currently employed in internal combustion engines.

a) A Four-Stroke internal combustion cycle has four piston movements over two engine revolutions for each cycle.

b) A Two-Stroke Cycle internal combustion cycle has two piston movements over one revolution for each cycle.

The Negative Pressure Operating Method differs from the four stroke or the two stroke cycle. The difference is in how the engine operates. The preferred method is to use only a One-Stroke per cycle process.

Valve Location—there are currently two primary designs with respect to valve location.

a) Valves in head (overhead valve), also called I Head engine.

b) Valves in block (flat head), also called L Head engine. There are historical designs where the designers of the engines placed the valves in block and had the intake valve on one side of the cylinder and the exhaust valve on the other side.

The Negative Pressure Operating Method can operate regardless of the location of the valves. A Negative Pressure Operating Method does not dictate the location of the valves and therefore makes the engine design process more flexible.

Basic Design—there are currently two primary engine designs.

a) The reciprocating engine is the most prevalent design and it has one or more cylinders in which pistons reciprocate back and forth. The combustion chamber is located in the closed end of each cylinder. Power is delivered to a rotating output crankshaft by mechanical linkage with the pistons.

b) The rotary engine is made of a block (stator) built around a large non-concentric rotor and crankshaft. The combustion chambers are built into the no rotating block.

The Negative Pressure Operating Method can be use in reciprocating or rotary engines.

Number of Cylinders—there are currently two primary engine designs.

a) Single Cylinder. The engine has one cylinder and one piston or rotor.

b) Multi Cylinder. The engine has multiple cylinders each with a piston or rotors. Common configurations include 2, 4, 6, 8 and 12 cylinders.

The Negative Pressure Operating Method can be used in engines with any quantity of cylinders.

Fuel Used a) Gasoline.

b) Diesel Oil or Fuel Oil.

c) Gas, Natural Gas, Methane.

d) LPG.

The Negative Pressure Operating Method is compatible with any fuel that can be used in internal combustion engines such as gasoline, diesel oil, fuel oils. Gases such as coal gas, natural gas, methane or Liquid Petroleum Gas (LPG).

This Negative Pressure Operating Method is compatible with a wide variety of other substances which can be used as fuel, including explosive substances, pure or non-pure oxygen, chemical mixtures, solids, liquids, gaseous, and compounds.

Any material that can be made to react with other substances so that it releases energy as thermal energy and results in an expansive force can to be used as a fuel in the Negative Pressure Operating Method.

A novel feature of the Negative Pressure Operating Method is that it does not have a compression stroke and does not require the use of a cam to operate the intake and exhaust valves.

The design of the process used in the Negative Pressure Operating Method:

1) The intake valve is open only from 1° to 40°.

2) The exhaust valve is open only for 180° to 360°.

The instant invention is a Negative Pressure Operating Method, comprises an internal combustion engine system that applies a negative pressure or expansive force to the fuel/air mixture to produce power in the cylinder with an increase of fuel economy, power, and torque.

This method of operation may require the use of a solenoid actuated engine valve for each intake and exhaust valve. This technology is adequately described in U.S. Pat. No. 6,575,126 B2 issued to Sturman on Jun. 10, 2003. However, the Negative Pressure Operating Method can use any equivalent system of solenoid operating valves.

During the phase of applying the negative compression or expansive force to the air charge, during which the intake and exhaust valves are closed, the valve actuators must be able to provide sufficient force to prevent the valves from opening due to the referenced force. The engines operated with this method of operation may be operated either with or without camshafts.

In a first preferred embodiment, the method comprises of the following steps within the engine:

1. producing an air intake to the combustion chamber;
2. applying a negative compression or expansive force to the air charge; and
3. igniting the fuel/air mixture by means of spark ignition, causing the combustion gas to expand, transferring power to the crankcase of the engine.

In second preferred embodiments, the method comprises of the following steps within the engine:

1. producing an air intake to the combustion chamber;
2. applying a negative compression or expansive force to the air charge; and
3. auto igniting the fuel/air mixture by means of compression ignition, causing the combustion gas to expand, transferring power to the crankcase of the engine.

The concept of a cam-less or free-valve piston engine has been discussed. The basic concept is an engine that has poppet valves operated by means of electromagnetic, hydraulic, or pneumatic actuators instead of conventional cams. Actuators could also be used to both open and close valves, or to open valves closed by springs or another means. Camshafts normally have one lobe per valve, with a fixed valve duration and lift. Although many modern engines use camshaft phasing, adjusting the lift and valve duration in a working engine is more difficult. Some manufacturers use systems with more than one cam lobe, but this is still a compromise as only a few profiles can be in operation at once. This is not the case with the cam-less engine, where lift and valve timing can be adjusted freely from valve to valve and from cycle to cycle. It also allows multiple lift events per cycle and, indeed, no events per cycle—switching off the cylinder entirely. This technology can be operated from various electrical and electronic systems including an Application-Specific Integrated Circuit (ASIC), a microprocessor, analog circuit, or other electric or mechanical timing system.

For a cam-less design, the opening and closing of the intake and exhaust valves required by this method cannot be achieved with the currently available cams and therefore leads one to the use of electromechanical valve actuators.

Electromagnetic Actuators for Cam-less Engines (or similar description) are currently available on the automobile market for engine manufacturers. Some valve manufactures include LaunchPoint Technologies Inc, Freevalve AB, GlideValve Engine Technology. Currently, cam-less engines using electromagnetic valve actuators are not available or in mass production.

The electromechanical valve actuators that can be used to facilitate cam-less operation must be able to provide sufficient force in the closed position that can exceed the negative pressure applied by the cylinder during the intake stroke.

The method of operation of a cam-less engine with a Negative Pressure Operating Method results in a vacuum or negative pressure being applied to a mixture of fuel and air prior to the application of the ignition source. The vacuum or negative pressure is applied during the downstroke of the cylinder between the 41° position and the 80° position. The position of the cylinder is referenced by the position of the crankshaft. The ignition source can be any device that is capable of producing a spark such as but not limited to a spark plug.

For purposes of the illustration, the crankshaft rotates in a clockwise direction.

The position of the cylinder referred to is the Top Of the Cylinder (TOC) when the head is at the top of the cylinder The 0° position is also the 360°, which is called Top Dead Center (TDC).

At the beginning of the cycle, the cylinder is at the 0° position as referenced by the position of the crankshaft. At the 0° position the intake and exhaust valves are in the closed position.

Since a Negative Pressure Operating Method engine can be used in either a Spark Ignition Powered Internal Combustion Engine or the Auto-Ignition Powered Internal Combustion Engine the disclosure will look at both ignition sequences.

Method 1; Spark Ignition Powered Internal Combustion Engine

Upon reaching the 1-degree position, as referenced by the position of the crankshaft, the intake valve opens drawing the mixture of fuel and air into the chamber.

The inlet valve will remain open until the piston reaches the 40-degree position, as referenced by the position of the crankshaft.

The inlet valve will close when the piston reaches the 41-degree position, as referenced by the position of the crankshaft.

The piston continues its downward movement until it reaches the 80-degree position, as referenced the position of the crankshaft. In this position and the intake valve is still closed, the ignition source is applied producing the combustion of the fuel-air mixture.

The piston continues its downward movement until it reaches the 81-degree position and the and the intake valve is still closed, as referenced the position of the crankshaft. the ignition source is applied producing the combustion of the fuel-air mixture.

The energy produced by combustion causes the piston to increase its speed and provide the energy necessary for the crankshaft to continue rotating until the next cycle is reached.

When the piston reaches the 180-degree position which is known as Bottom Dead Center (BDC) as referenced by the position of the crankshaft, the outlet valve opens. The outlet valve will open until it reaches the 360° position, TDC, which is equivalent to the 0° position, as referenced by the position of the crankshaft. Then the one cycle of the engine is completed in one revolution. The one cycle consists of the intake phase, the application of vacuum phase, the ignition phase, and the exhaust phase which saves energy and increases efficiency.

Method 2; Auto-Ignition Powered Internal Combustion Engine

Upon reaching the 1-degree position, as referenced by the position of the crankshaft, the intake valve opens drawing the mixture of fuel and air into the chamber. The inlet valve will remain open until the piston reaches the 40-degree position, as referenced by the position of the crankshaft. The inlet valve will close when the piston reaches the 41-degree position, as referenced by the position of the crankshaft.

The piston continues its downward movement until it reaches the 80-degree position, as referenced the position of the crankshaft. Near this position, the fuel-air mixture will auto-ignite.

The energy produced by combustion causes the piston to increase its speed and provide the energy necessary for the crankshaft to continue rotating until the next cycle is reached. When the piston reaches the 180-degree position Bottom Dead Center (BDC), as referenced by the position of the crankshaft, the outlet valve opens. The outlet valve will open until it reaches the 360-degree position, TDC, which is equivalent to the 0-degree position, as referenced by the position of the crankshaft.

This ends the one cycle of the engine which has completed one revolution. The One cycle consists of the intake phase, the application of vacuum phase, the auto-ignition phase, and the exhaust phase.

The instant invention for an ignition source engine can also be described as follows.

A negative pressure internal combustion engine having a cylinder, a piston, at least one intake valves, at least one exhaust valves, a connecting rod, a crank shaft wherein a cycle is mapped to a 360-degree motion of the crankshaft by the connection point of the connecting rod to the camshaft and the piston is connected to a connecting rod at an upper connecting rod connection point and a camshaft at a lower connecting rod connection point and the cycle comprises:

a. a first position of the cycle wherein the piston is in the upper position wherein the lower connecting rod connection point is at 0-degree on the camshaft and the inlet valves and the outlet valves are closed;

b. a second position of the cycle wherein the piston moves from the upper position and the lower connecting rod connection point is at 1-degree on the crankshaft and the at least one intake valve is opened and remains open until a third position wherein the lower connecting rod connection point is at 40-degrees on the camshaft and the piston moves from the upper position to a second position allowing a fuel and air mixture to enter the cylinder;

c. a third position of the cycle wherein the piston moves and the lower connecting rod connection point is at 41-degrees on the crankshaft and the at least one intake valve closes;

d. a fourth position of the cycle wherein the piston moves from the third position to the fourth position and the lower connecting rod connection point is at 80-degrees on the crankshaft and an ignition source is applied in the cylinder resulting in combustion of the fuel and air mixture and the piston moves to a fifth position from the fourth position and the lower connecting rod connection point is at 180-degrees on the crankshaft when the piston is at the fifth position and the at least one exhaust valve opens; and e. a sixth position of the cycle wherein the piston moves from the fifth position and the lower connecting rod connection point is at 0-degrees on the crankshaft and the at least one exhaust valve closes.

The cycle wherein at least one intake valve is operated by an electromechanical valve actuator.

The cycle wherein at least one exhaust valve is operated by an electromechanical valve actuator.

The instant invention for an ignition source engine can also be described as follows.

A negative pressure internal combustion engine having a cylinder, a piston, at least one intake valves, at least one exhaust valves, a connecting rod, a crank shaft wherein a cycle is mapped to a 360-degree motion of the crankshaft by the connection point of the connecting rod to the camshaft and the piston is connected to a connecting rod at an upper connecting rod connection point and a camshaft at a lower connecting rod connection point and the cycle comprises:

a. a first position of the cycle wherein the piston is in the upper position wherein the lower connecting rod connection point is at 0-degree on the camshaft and the inlet valves and the outlet valves are closed;

b. a second position of the cycle wherein the piston moves from the upper position and the lower connecting rod connection point is at 1-degree on the crankshaft and the at least one intake valve is opened and remains open until a third position wherein the lower connecting rod connection point is at 40-degrees on the camshaft and the piston moves from the upper position to a second position allowing a fuel and air mixture to enter the cylinder;

c. a third position of the cycle wherein the piston moves and the lower connecting rod connection point is at 41-degrees on the crankshaft and the at least one intake valve closes;

d. a fourth position of the cycle wherein the piston moves from the third position to the fourth position and the lower connecting rod connection point is at 80-degrees on the crankshaft and the fuel and air mixture combust due to the pressure and the piston moves to a fifth position from the fourth position and the lower connecting rod connection point is at 180-degrees on the crankshaft when the piston is at the fifth position and the at least one exhaust valve opens; and e. a sixth position of the cycle wherein the piston moves from the fifth position and the lower connecting rod connection point is at 0-degrees on the crankshaft and the at least one exhaust valve closes.

The cycle wherein at least one intake valve is operated by an electromechanical valve actuator.

The cycle wherein at least one exhaust valve is operated by an electromechanical valve actuator.

The different valve positions and the application of the ignition source, during any degree of the cycle or position of the crankshaft and/or piston position, will allow to operate the engine with various power settings. The revolutions may be increased or decreased as needed for various operating scenarios. Cylinder deactivation may be achieved by these instant variations.

The intake and the exhaust valve(s) can be instantly varied to open and/or close at any position (degree) of the crankcase and/or piston position. These variations will produce different levels of power and/or increase or decrease the revolutions per minute (RPM) of the engine.

The intake and the exhaust valve(s) can be instantly varied to open and/or close at any time (degree) of the cycle. These variations will produce different levels of power and/or revolutions per minute (RPM) of the engine.

The ignition spark may be applied to the fuel mixture at any position of the crankcase and/or piston position.

The ignition spark may be applied to the fuel mixture at any position of the crankcase and/or piston position and/or valve position, (open or closed).

Referring now to the drawings FIGS. 1-10, and more particularly to FIG. 1, there is shown a flow chart of the Negative Pressure Operating Method using a Spark Ignition Powered Internal Combustion Engine process.

a. Step 100 is the initiation of the cycle at the 0-degree or 360-degree position, Top Dead Center (TDC).

b. Step 110 is at the 1-degree position of the cycle and the intake valve opens and the negative pressure inside the cylinder allows the fuel mixture to enter the chamber under vacuum until the 40-degree position.

c. Step 120 is at the 41-degree position of the cycle. The intake valve closes trapping the fuel mixture in the chamber. The fuel mixture is subject to negative pressure from 41-degrees to 80-degrees.

d. Step 130 is at the 81-degree position of the cycle and the ignition spark is applied to the fuel mixture producing an explosion and the power produced from the explosion is transmitted from the piston to the crankshaft by the connecting rod.

e. Step 140 from the 180-degree position of the cycle Bottom Dead Center (BDC) to the 0-degree or 360-degree position Top Dead Center (TDC) the exhaust valve is in the open position and the intake valve is in the closed position to allow the piston to push the consumed fuel mixture out of the cylinder.

Figure 2:
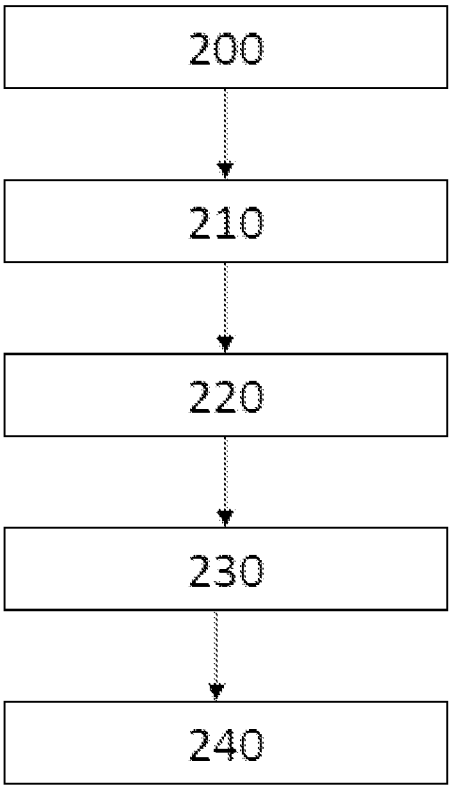
FIG. 2 is a flow chart of the Negative Pressure Operating Method using a Compression Ignition Powered Internal Combustion Engine process.

FIG. 2 is a flow chart of the Negative Pressure Operating Method using a Compression Ignition Powered Internal Combustion Engine process.

a. Step 200 is the initiation of the cycle at the 0-degree or 360-degree position, Top Dead Center (TDC).
b. Step 210 is at the 1-degree position of the cycle and the intake valve opens and the negative pressure inside the cylinder allows the fuel mixture to enter the chamber under vacuum and the intake valve remains open until 40-degrees. The negative pressure inside the cylinder allows the fuel mixture to enter the chamber under vacuum.
c. Step 220 is at the 41-degree position of the cycle and the intake valve closes tarping the fuel mixture in the chamber.
d. Step 230 is at the 80-degree position the fuel mixture will auto ignite producing an explosion and the power produced from the explosion is transmitted from the piston to the crankshaft by the connecting rod.
e. Step 240 from the 180-degree position of the cycle Bottom Dead Center (BDC) to the 0-degree or 360-degree position Top Dead Center (TDC) the exhaust valve is in the open position and the intake valve is in the closed position to allow the piston the push the consumed fuel mixture out of the cylinder.

Figure 3:
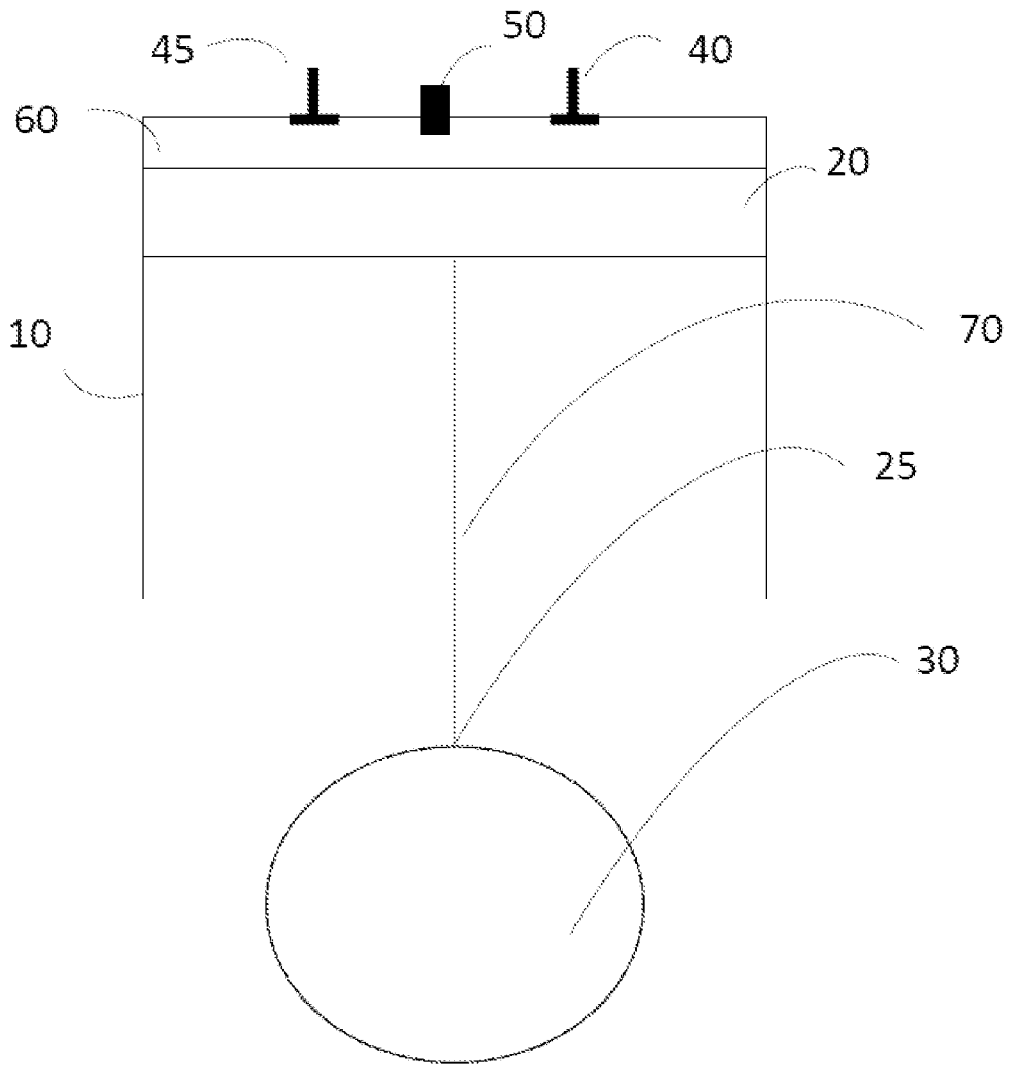
FIG. 3 is a schematic of the piston used in the instant invention and the piston is at 0-degrees or Top Dead Center.

FIG. 3 is a schematic of a Negative Pressure Operating Method using a Spark Ignition Powered Internal Combustion Engine process. The schematic shows the piston 20 is in cylinder 10 with ignition source 50, connecting rod 70, the exhaust valve 45 is closed, intake valve 40 is closed and the piston 20 is at 0-degree position 25 of crankshaft 30 or Top Dead Center. Cylinder 10 and piston 20 form chamber 60. In this figure the piston 20 is in the 0-degree or 360-degree position 25 or "Top Dead Center" TDC position with the intake 40 and exhaust valves 45 are both in the closed position.

Figure 4:
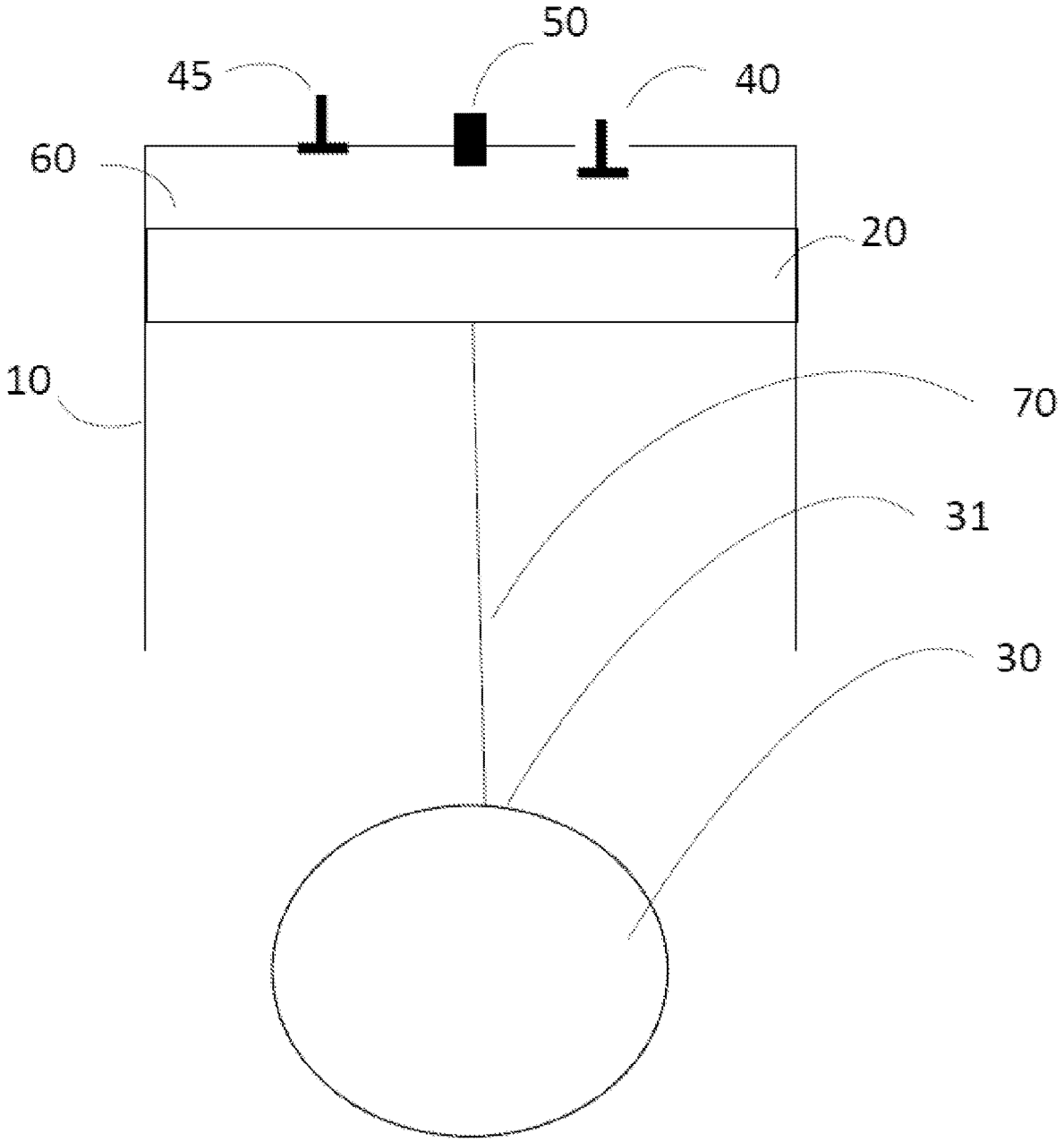
FIG. 4 is a schematic of the piston used in the instant invention and the piston is at 1-degree.

FIG. 4 is a schematic of a Negative Pressure Operating Method using a Spark Ignition Powered Internal Combustion Engine process when the intake vale opens. The piston 20 is in cylinder 10, with ignition source 50, connecting rod 70 and the piston 20 is at 1-degree position 31 of crankshaft 30. In this figure the piston 20 is in the 1-degree position 31 of crankshaft 30 and intake valve 40 in the open position and exhaust valve 45 is in the closed position.

Figure 5:
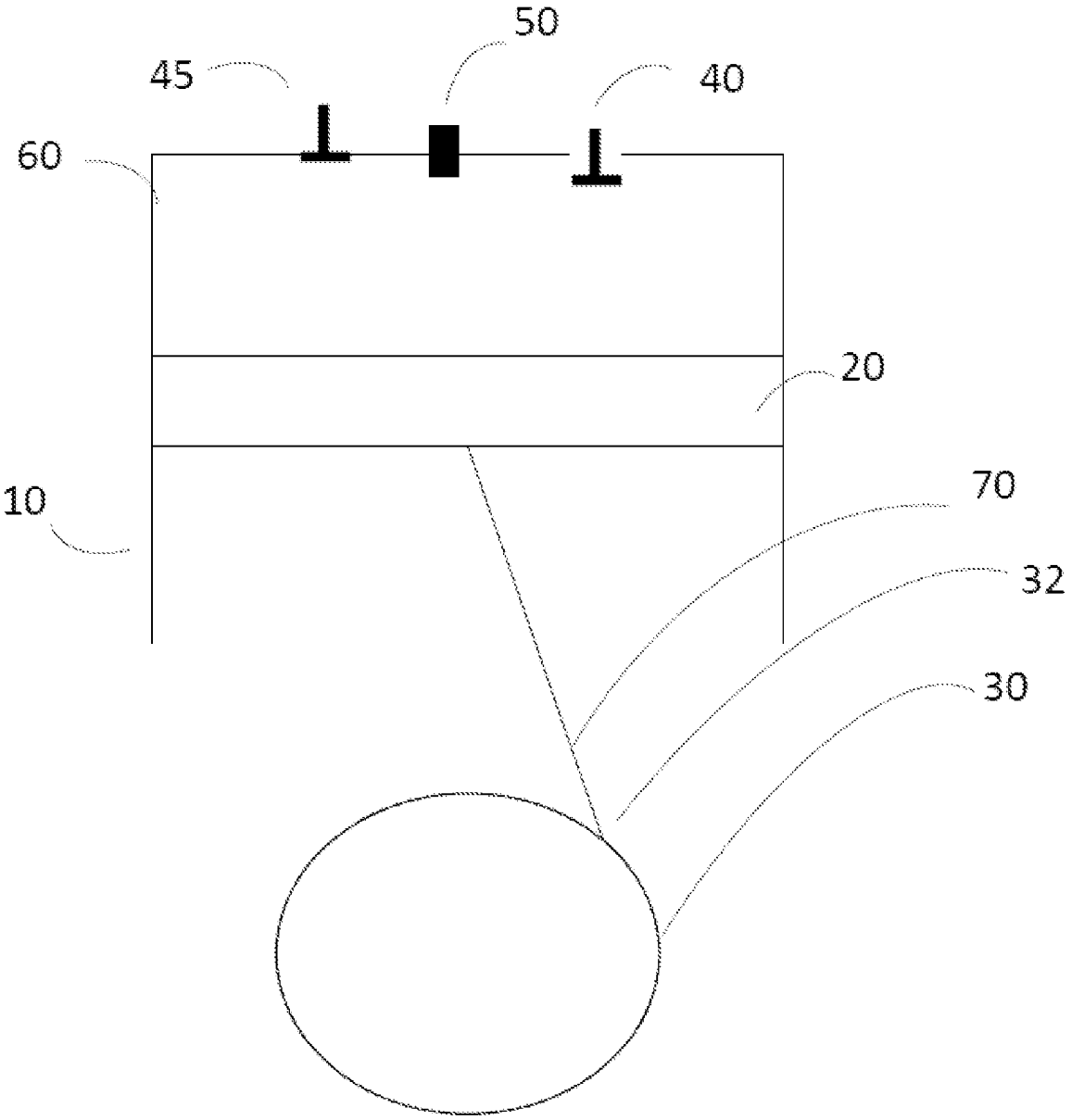
FIG. 5 is a schematic of the piston used in the instant invention and the piston is at 40-degrees.

FIG. 5 is a schematic of the Negative Pressure Operating Method using a Spark Ignition Powered Internal Combustion Engine process when showing piston 20 in cylinder 10, with ignition source 50, connecting rod 70 and piston 20 is at 40-degrees position 32 of crankshaft 30. In this figure the piston 20 is in the 40-degree position 32 and the intake valve 40 is in the open position exhaust valve 45 is in the closed position.

Figure 6:
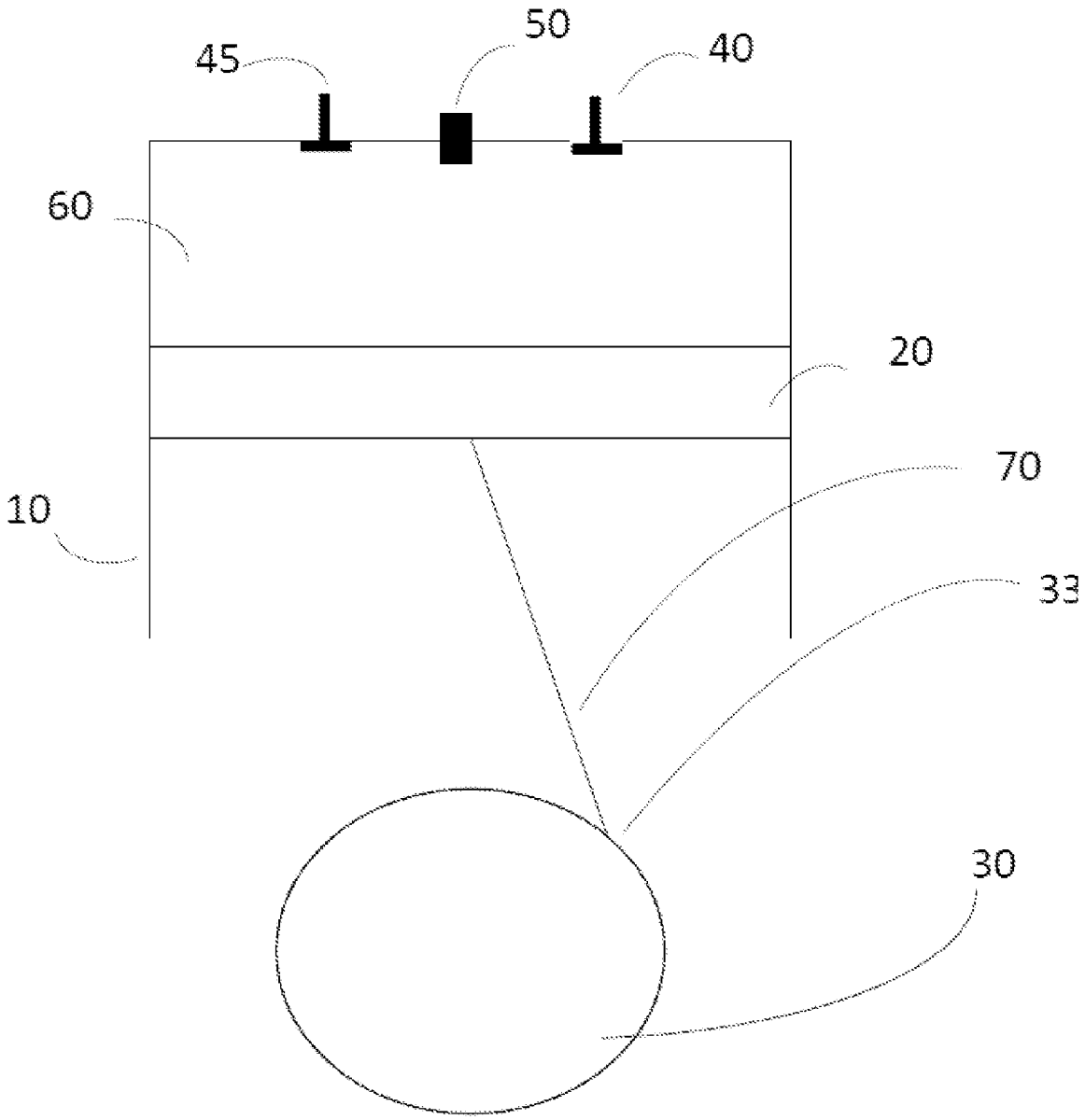
FIG. 6 is a schematic of the piston used in the instant invention and the piston is at 41-degrees.

FIG. 6 is a schematic of the Negative Pressure Operating Method using a Spark Ignition Powered Internal Combustion Engine process in cylinder 10, with ignition source 50, connecting rod 70 and piston 20 is at 41-degree position 33. In this figure the piston 20 is in the 41 degrees position 33 and the intake valve 40 is in the closed position and the exhaust valve 45 is in the closed position. The downward travel of the cylinder applies a negative pressure to the fuel/air mixture.

Figure 7:
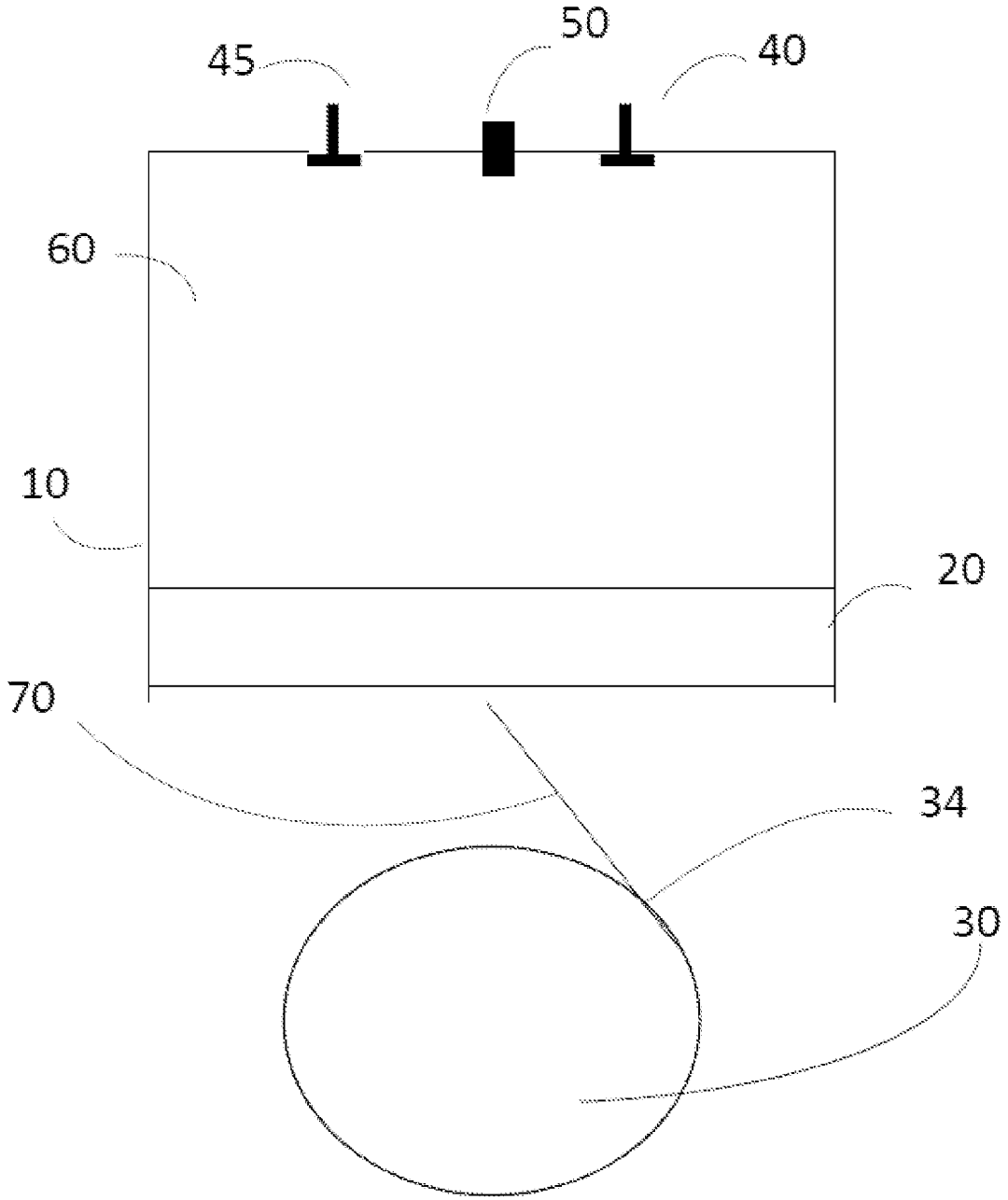
FIG. 7 is a schematic of the piston used in the instant invention and the piston is at 80-degrees.

FIG. 7 is a schematic of the Negative Pressure Operating Method using a Spark Ignition Powered Internal Combustion Engine process in cylinder 10, with ignition source 50, connecting rod 70 and piston 20 is at 81-degree position 34. In this figure the piston 20 is in the 80-degree position 34 and the intake valve 40 is closed.

Figure 8:
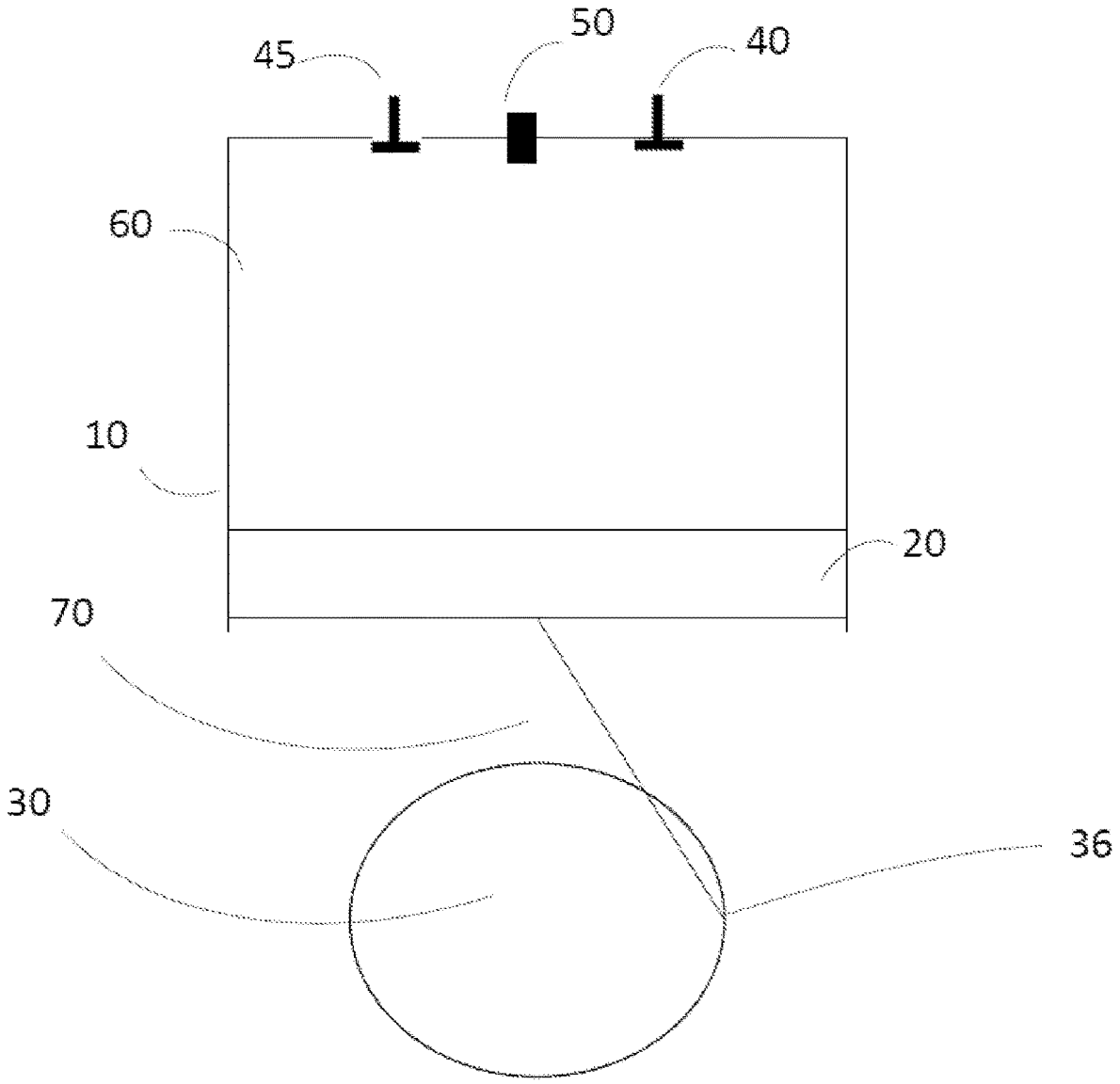
FIG. 8 is a schematic of the piston used in the instant invention and the piston is at 81-degrees.

FIG. 8 is a schematic of the Negative Pressure Operating Method using a Spark Ignition Powered Internal Combustion Engine process showing piston 20, with ignition source 50, connecting rod 70 and piston 20 is at 81-degree position 36. In this figure the piston 20 is in the at 81-degree position 36 and the intake valve 40 is in the closed position and the exhaust valve 45 is in the closed position. In this position an ignition source 50 is applied to the fuel/air mixture which is under a negative compression or expansive force.

Figure 9:
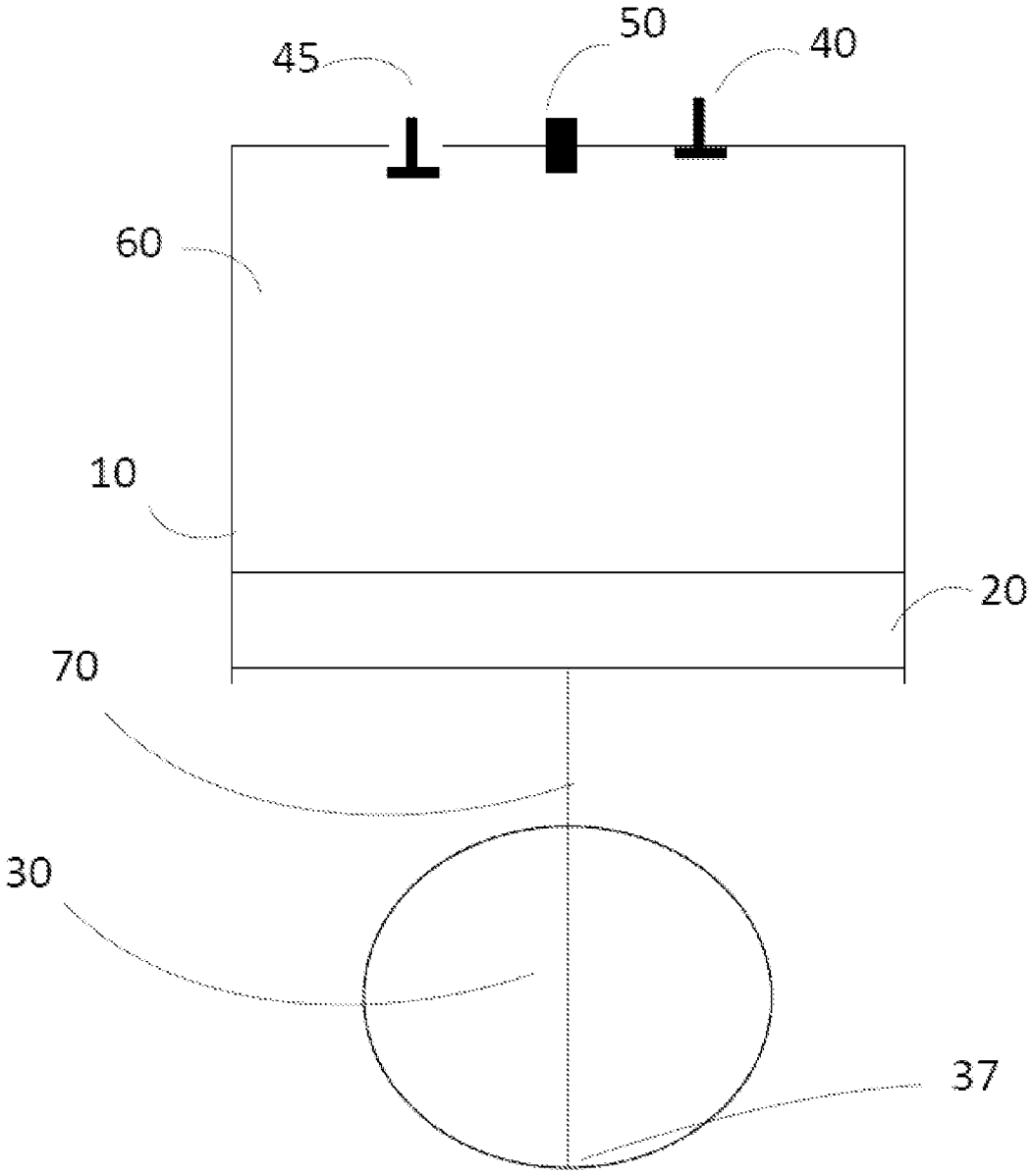
FIG. 9 is a schematic of the piston used in the instant invention and the piston is at 180-degree.

FIG. 9 is a Negative Pressure Operating Method using a Spark Ignition Powered Internal Combustion Engine process showing piston 20, with ignition source 50, connecting rod 70 and piston 20 is at 180-degree position 37. In this figure the piston 20 is at 180-degree position 37 which is defined as "Bottom Dead Center" (BDC) position and the exhaust valve 46 is in the opened position and the intake valve 40 is in the closed position. The exhaust valve 46 and the intake valve 40 status will be maintained until the cylinder reaches the Top Dead Center, TDC, 360° position. During this stroke the exhaust gases are discharged.

Figure 10:
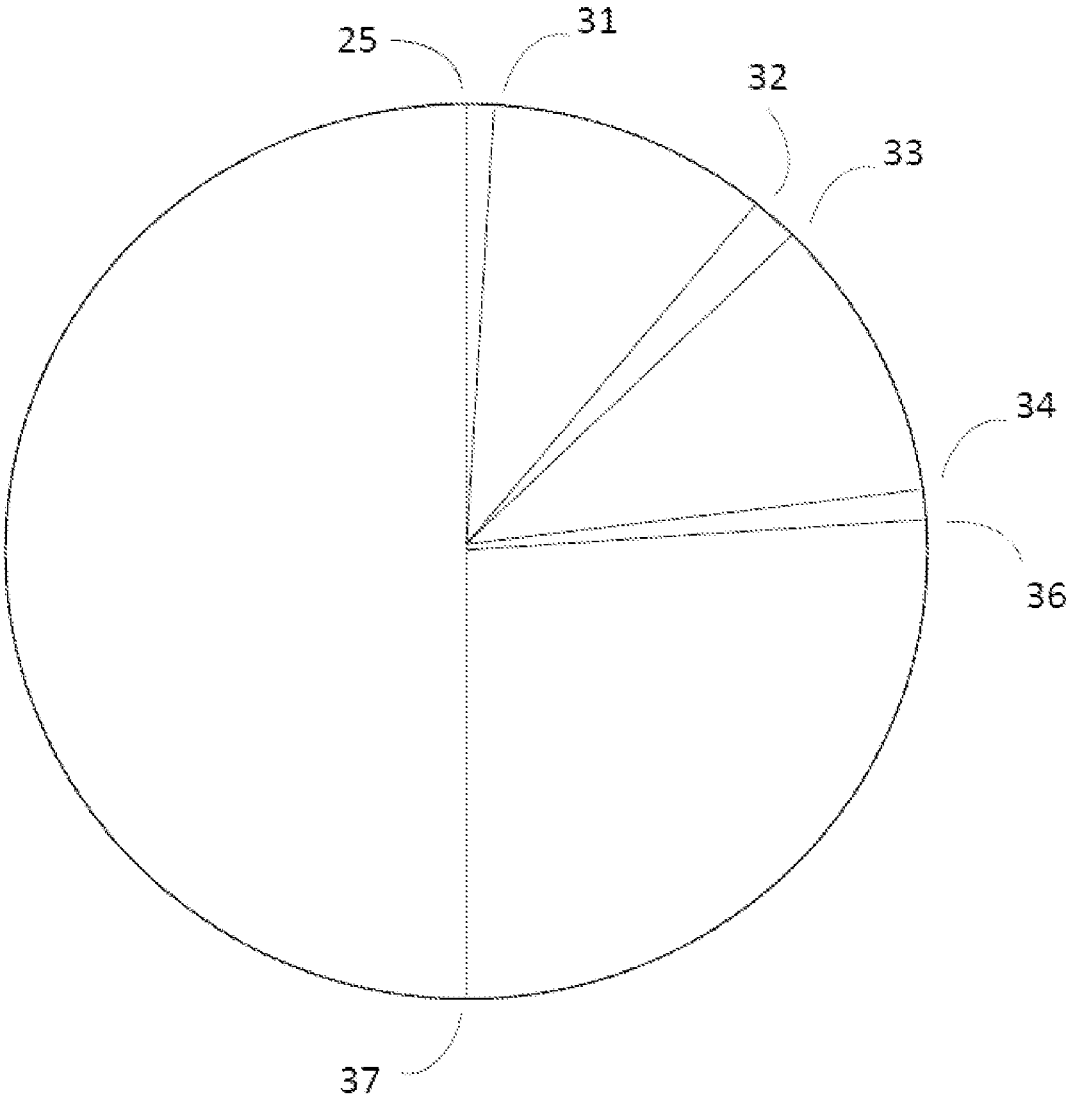
FIG. 10 is a schematic of the cycle of the instant invention and the piston using 360-degree circle graph.

FIG. 10 is a schematic of the cycle of the instant invention and the piston using 360-degree circle graph. Position 25 is top dead center (TDC) or the 0-degree or 360-degree position. Position 31 is the 1-degree position, position 32 is the 40-degree position, position 33 is the 41-degree position, position 34 is the 80-degree position and position 36 is the 81-degree position. Position 37 is the Bottom Dead Center (BDC) which is the 180-degree position.

The difference in the process of the Negative Pressure Operating Method using a Compression Ignition Powered Internal Combustion Engine process versus the Negative Pressure Operating Method using a Spark Ignition Powered Internal Combustion Engine process is that instead of initiating combustion using an ignition source the system uses the compression of the fuel and air mixture to create the combustion (explosion).

Since many modifications, variations, and changes in detail can be made to the described embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

In addition, the present invention has been described with reference to embodiments, it should be noted and understood that various modifications and variations can be crafted by those skilled in the art without departing from the scope and spirit of the invention. Accordingly, the foregoing disclosure should be interpreted as illustrative only and is not to be interpreted in a limiting sense. Further it is intended that any other embodiments of the present invention that result from any changes in application or method of use or operation, method of manufacture, shape, size, or materials which are not specified within the detailed written description or illustrations contained herein are considered within the scope of the present invention.

Insofar as the description above and the accompanying drawings disclose any additional subject matter that is not within the scope of the claims below, the inventions are not dedicated to the public and the right to file one or more applications to claim such additional inventions is reserved.

Although very narrow claims are presented herein, it should be recognized that the scope of this invention is much broader than presented by the claim. It is intended that broader claims will be submitted in an application that claims the benefit of priority from this application.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A negative pressure internal combustion engine having a cylinder, a piston, at least one intake valves, at least one exhaust valves, a connecting rod, a crank shaft wherein a cycle is mapped to a 360-degree motion of said crankshaft by the connection point of said connecting rod to said camshaft and said piston is connected to a connecting rod at an upper connecting rod connection point and a camshaft at a lower connecting rod connection point and said cycle comprises:

a. a first position of said cycle wherein said piston is in the upper position wherein said lower connecting rod connection point is at 0-degree on said camshaft and said inlet valves and said outlet valves are closed;

b. a second position of said cycle wherein said piston moves from said upper position and said lower connecting rod connection point is at 1-degree on said crankshaft and said at least one intake valve is opened and remains open until a third position wherein said lower connecting rod connection point is at 40-degrees on said camshaft and said piston moves from said upper position to a second position allowing a fuel and air mixture to enter said cylinder;

c. a third position of said cycle wherein said piston moves and said lower connecting rod connection point is at 41-degrees on said crankshaft and said at least one intake valve closes;

d. a fourth position of said cycle wherein said piston moves from said third position to said fourth position and said lower connecting rod connection point is at 80-degrees on said crankshaft and an ignition source is applied in said cylinder resulting in combustion of said fuel and air mixture and said piston moves to a fifth position from said fourth position and said lower connecting rod connection point is at 180-degrees on said crankshaft when said piston is at said fifth position and said at least one exhaust valve opens; and e. a sixth position of said cycle wherein said piston moves from said fifth position and said lower connecting rod connection point is at 0-degrees on said crankshaft and said at least one exhaust valve closes.

2. The cycle of claim 1 wherein said at least one intake valve is operated by an electromechanical valve actuator.

3. The cycle of claim 1 wherein said at least one exhaust valve is operated by an electromechanical valve actuator.

4. A negative pressure internal combustion engine having a cylinder, a piston, at least one intake valves, at least one exhaust valves, a connecting rod, a crank shaft wherein a cycle is mapped to a 360-degree motion of said crankshaft by the connection point of said connecting rod to said camshaft and said piston is connected to a connecting rod at an upper connecting rod connection point and a camshaft at a lower connecting rod connection point and said cycle comprises:

a. a first position of said cycle wherein said piston is in the upper position wherein said lower connecting rod connection point is at 0-degree on said camshaft and said inlet valves and said outlet valves are closed;

b. a second position of said cycle wherein said piston moves from said upper position and said lower connecting rod connection point is at 1-degree on said crankshaft and said at least one intake valve is opened and remains open until a third position wherein said lower connecting rod connection point is at 40-degrees on said camshaft and said piston moves from said upper position to a second position allowing a fuel and air mixture to enter said cylinder;

c. a third position of said cycle wherein said piston moves and said lower connecting rod connection point is at 41-degrees on said crankshaft and said at least one intake valve closes;

d. a fourth position of said cycle wherein said piston moves from said third position to said fourth position and said lower connecting rod connection point is at 80-degrees on said crankshaft and said fuel and air mixture combust due to said pressure and said piston moves to a fifth position from said fourth position and said lower connecting rod connection point is at 180-degrees on said crankshaft when said piston is at said fifth position and said at least one exhaust valve opens; and e. a sixth position of said cycle wherein said piston moves from said fifth position and said lower connecting rod connection point is at 0-degrees on said crankshaft and said at least one exhaust valve closes.

5. The cycle of claim 4 wherein said at least one intake valve is operated by an electromechanical valve actuator.

6. The cycle of claim 4 wherein said at least one exhaust valve is operated by an electromechanical valve actuator.

* * * * *